US008342359B2

(12) United States Patent
Cannon, III et al.

(10) Patent No.: US 8,342,359 B2
(45) Date of Patent: Jan. 1, 2013

(54) CONDIMENT AND SAUCE CONTAINER WITH GRIPPING AREA

(75) Inventors: Arthur Dickson Cannon, III, Hiawassee, GA (US); Devin Lee Moore, Decatur, GA (US); Jesse Marie Newton, Atlanta, GA (US); Alex Worthy Newton, Atlanta, GA (US); Brian Andrew Wong-Shui, Atlanta, GA (US)

(73) Assignee: Cannon Financial, Inc., Atlanta, GA (US)

( * ) Notice: Subject to any disclaimer, the term of this patent is extended or adjusted under 35 U.S.C. 154(b) by 190 days.

(21) Appl. No.: 12/857,042

(22) Filed: Aug. 16, 2010

(65) Prior Publication Data

US 2012/0037653 A1 Feb. 16, 2012

(51) Int. Cl.
*B65D 41/16* (2006.01)
*B65D 39/00* (2006.01)
*B65D 8/12* (2006.01)

(52) U.S. Cl. ..... 220/780; 220/790; 220/791; 220/669

(58) Field of Classification Search ..... 220/669, 220/657, 658, 670, DIG. 13, 674, 780, 781, 220/788, 789, 791–793, 4.21; 215/321, 43; 40/311

See application file for complete search history.

(56) References Cited

U.S. PATENT DOCUMENTS

| | | | | |
|---|---|---|---|---|
| D75,735 | S | 7/1928 | Kintz | |
| D91,251 | S | 12/1933 | Rettich | |
| D172,854 | S | 8/1954 | Waldo | |
| 2,833,324 | A * | 5/1958 | Burroughs | 220/790 |
| D265,061 | S | 6/1982 | Tricinella | |
| 5,397,036 | A | 3/1995 | Maiwald | |
| 5,676,990 | A | 10/1997 | Wawrzynski | |
| 5,894,957 | A | 4/1999 | Egel | |
| D412,448 | S | 8/1999 | Bentson | |
| D471,668 | S | 3/2003 | Cheung | |
| 7,090,116 | B2 * | 8/2006 | Cutler et al. | 229/400 |
| D540,620 | S * | 4/2007 | Bushkovsky | D7/509 |
| 2002/0039609 | A1 | 4/2002 | Bezek et al. | |
| 2004/0129590 | A1 | 7/2004 | Petricca | |
| 2008/0160143 | A1 | 7/2008 | Edwards et al. | |
| 2009/0301923 | A1 | 12/2009 | Van Puijenbroek | |

OTHER PUBLICATIONS

International Search Report and Written Opinion for International Patent Application No. PCT/US/11/47963; Feb. 14, 2012.

* cited by examiner

*Primary Examiner* — Robin Hylton
(74) *Attorney, Agent, or Firm* — Jason A. Bernstein; Barnes & Thornburg LLP

(57) ABSTRACT

A container for holding a dipping condiment or sauce and allowing a user to wipe a food item to remove excess condiment or sauce. The container has a base and a side wall having one portion higher than an opposing portion, the wall including at least one ridge, groove or other fluid retention device. The wall also includes a pair of opposing inwardly curved gripping surfaces for facilitating gripping by a user's fingers, the gripping surfaces including ribs or grooves. The container may also include a lid which snap fits onto the lip of the container.

7 Claims, 10 Drawing Sheets

CONDIMENT AND SAUCE CONTAINER WITH GRIPPING AREA

FIELD

The present invention relates to containers for holding, storing and dispensing liquids, such as sauce, dressing or other items.

BACKGROUND

Food items served with sauces or other condiments (such as ketchup, mustard, dressings, or the like) for dipping are common (generically, the foregoing referred to herein as condiments). Typically, the condiment is provided in a small round plastic container which may or may not have a lid. A problem with such a container is that it is not convenient or efficient to remove excess condiment on the container rim after the food item is dipped therein, resulting in excess condiment remaining on the food item. Also, round containers are difficult to grasp when a user's fingers may be slippery from condiment, grease, or the like which may accumulate during eating.

It would be desirable to have a condiment container which would provide a more effective and efficient means to remove excess condiment on a dipped food item. It would also be desirable to have a condiment container which could be easily grasped in a user's fingers even if the fingers are slippery.

SUMMARY

Generally described, the present invention provides in a first exemplary embodiment a container for holding and storing sauces and other liquids, comprising a base having a generally flat base bottom, a generally frusto-conical wall extending upward from the bottom and having a rim, the wall having a first section, a second section opposing the first section, the first section having a height greater than the second section, a third section, and a fourth section opposing the third section, the third and fourth sections each having an inwardly curved gripping section, the gripping section having at least one gripping surface a lip extending substantially around the rim of the wall.

The wall first section has at least one and preferably a plurality of fluid retention devices for retaining fluid when a food item is wiped across the retention devices. The retention devices can be ribs, grooves, bumps, other protrusions, combinations and mixtures of the foregoing or the like.

The container may have a lid adapted to snap fit over the lip, the lid having a generally flat lid bottom, a lid wall extending upward from the lid bottom, the lid wall having a first section and a second section, the first section having a height greater than the second section, a seal portion comprising a first flange extending generally outward and generally perpendicular to the lid wall and a second flange extending generally downward from the first flange, the seal portion being adapted to mate with the lid and form a seal therewith, whereby the lid wall first section is generally aligned with the base wall first section.

The gripping section may include a plurality of retention devices to facilitate gripping. The retention devices can be grooves, ribs, bumps, combinations of the foregoing or the like.

The container is preferably constructed to allow a number of containers to nest and stack to minimize storage space. The lid is similarly constructed. When the lid is attached to the container a number of lid-container units can be stacked to permit storage of pre-filled containers.

Other features of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION

Figure 1:
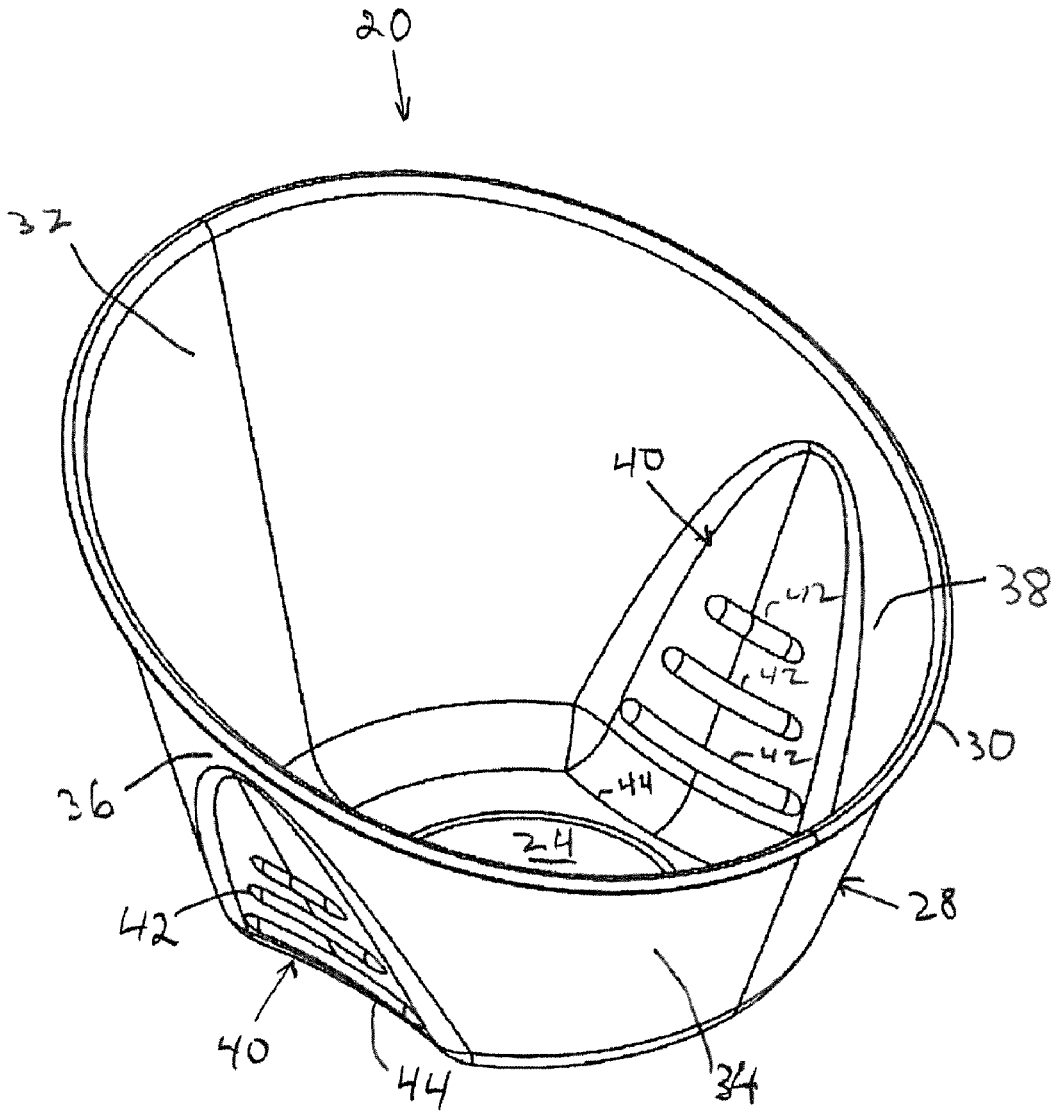
FIG. 1 is a perspective view of a container base according to one exemplary embodiment of the present invention.
Figure 2:
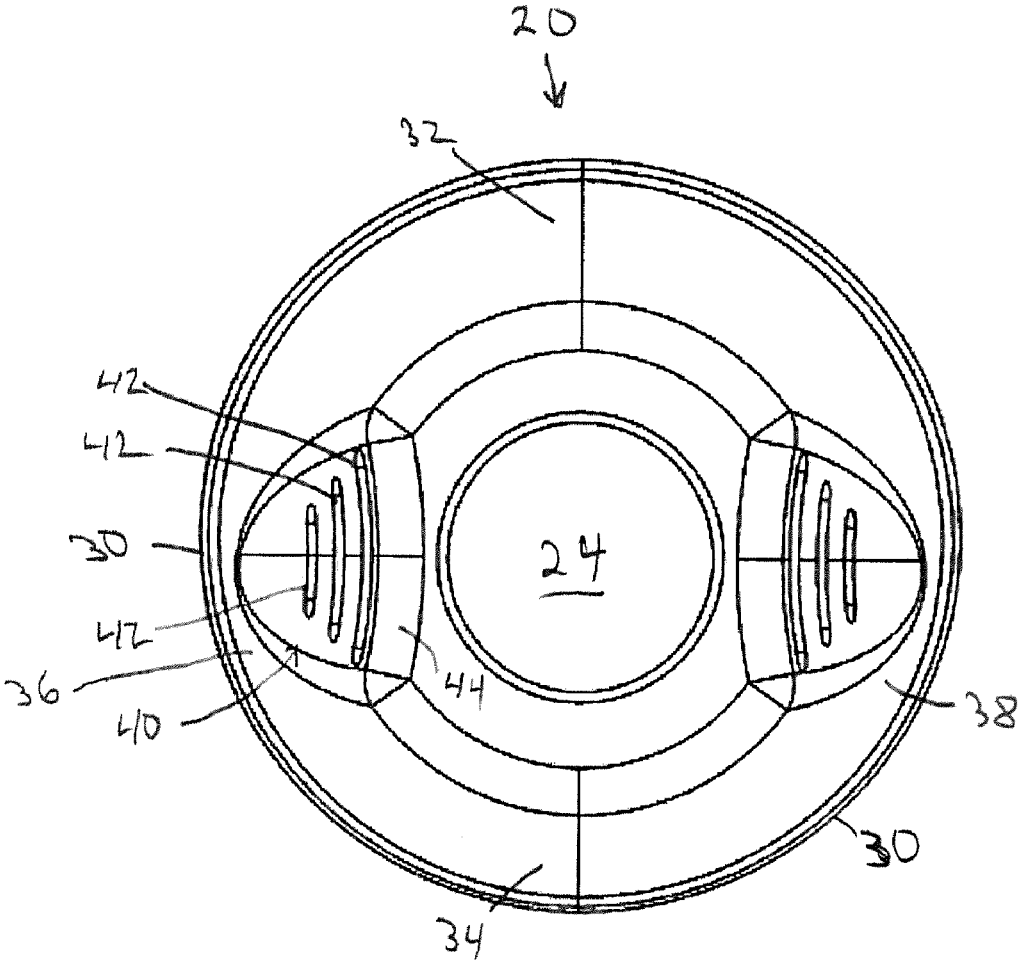
FIG. 2 is a bottom plan view of the base of FIG. 1.
Figure 3:
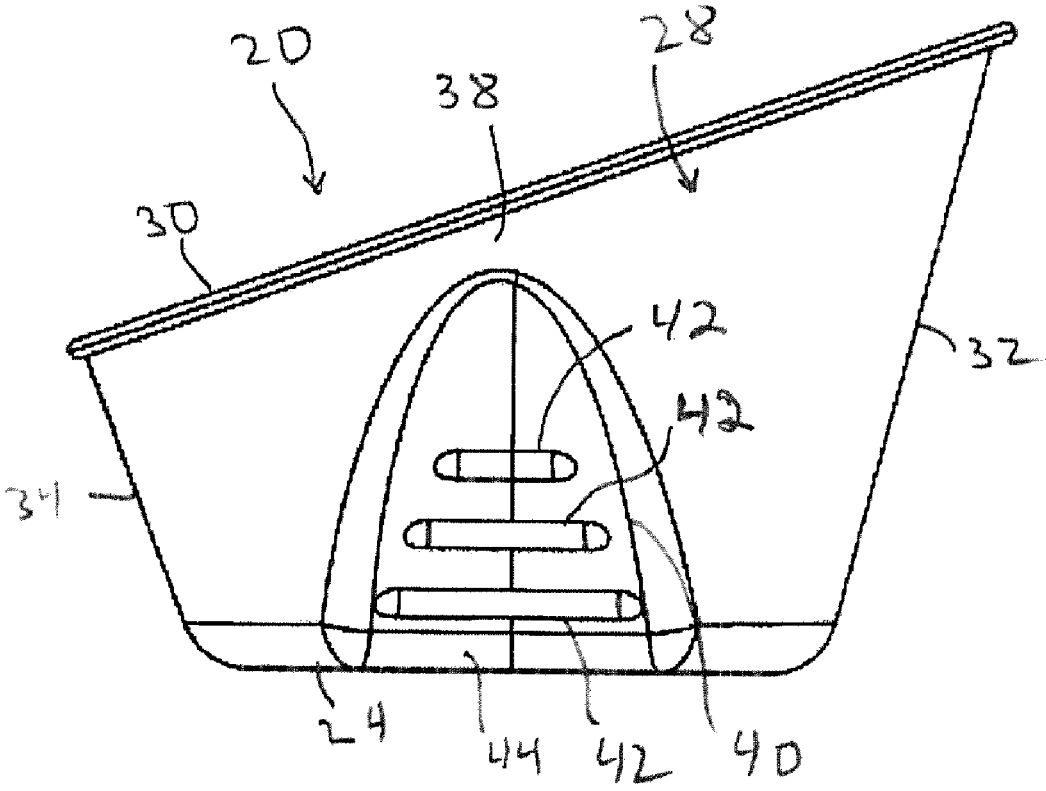
FIG. 3 is a side elevation view of the base of FIG. 1.
Figure 4:
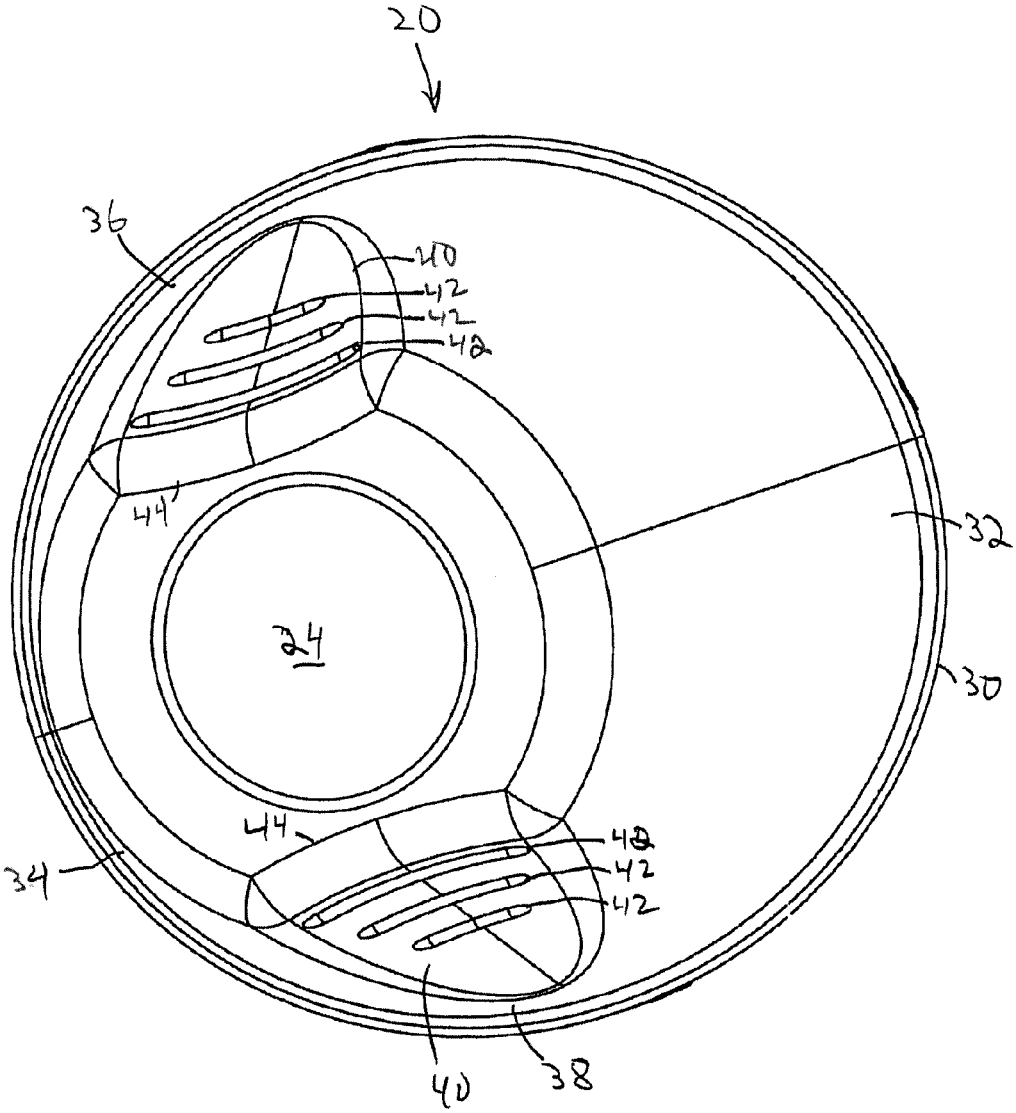
FIG. 4 is a top plan view of the base of FIG. 1.

FIGS. 1-7 show one exemplary embodiment of a container 10 having a base 20 and a lid 22. FIGS. 1-4 show the details of the base 20, which generally has a bottom 24, a wall 28 and a rim forming a lip 30.

The wall 28 has a first section 32, second section 34, third section 36 and fourth section 38. The first and second sections 32, 34 oppose each other and the first section 32 has a height greater than that of the second section 34 so that the lip 30 is angled with respect to the base 20. The wall 28 may flare outward in a generally frusto-conical shape. The general relationship between the diameter of the base 20 and the lip 30 is such that a container is created which, when placed on a flat surface, is generally resistant to tipping when a condiment is placed therein.

The third and fourth sections 36, 38 oppose each other and each has a recessed area which serves as a gripping area 40. Each recessed gripping area 40 may curve inward slightly so that a user can grip the gripping areas 40 with a thumb and opposing finger. Each gripping area 40 may optionally have one or more gripping surfaces 42, which may take the form of protrusions, grooves, recesses, ribs, ridges, steps, bumps, spikes, domes, fingers, nibs, and combinations of the foregoing. The gripping area 40 may extend to the base 20 (as shown in FIG. 1) or may extend only toward the base 20. If the former, the gripping area 40 may optionally create a curved notched out area 44 in the base 20.

The lip 30 may extend outward from the wall 28. Alternatively, the lip 30 may have a flange which extends both outward and inward.

Figure 5:
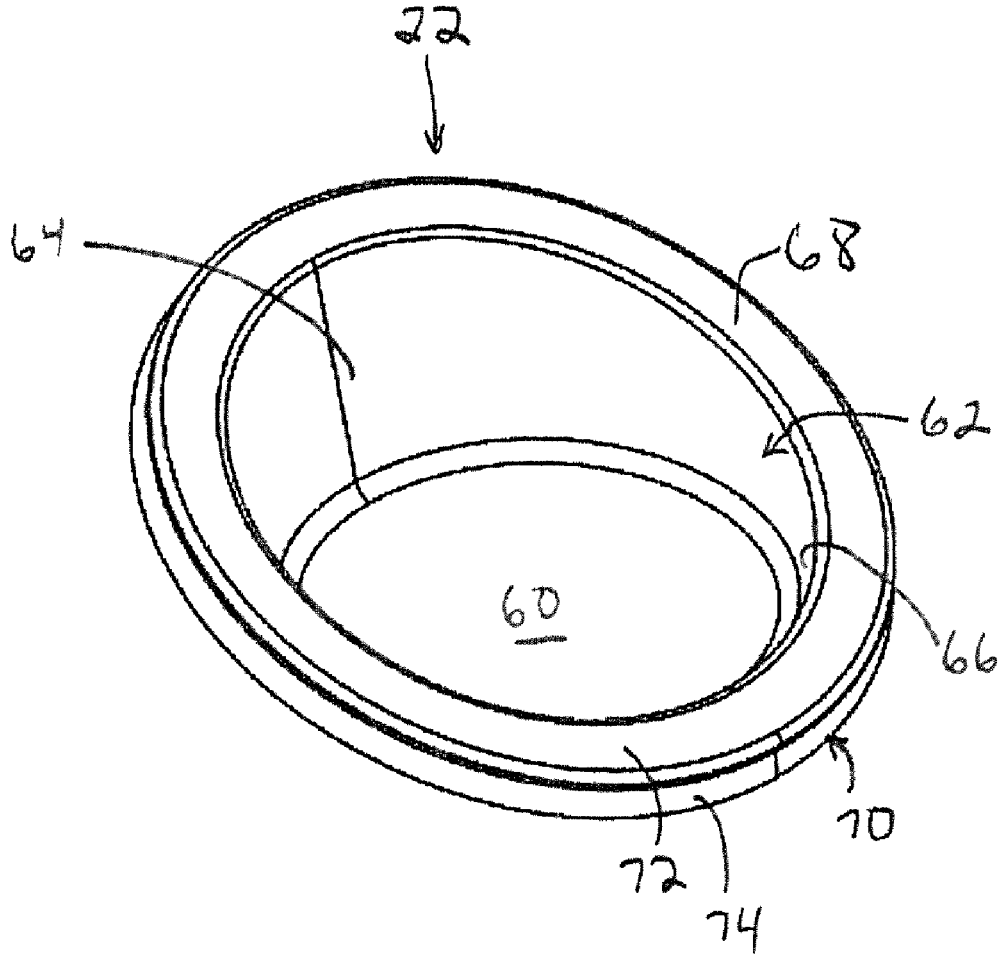
FIG. 5 is a perspective view of a lid according to one exemplary embodiment of the present invention.
Figure 6:
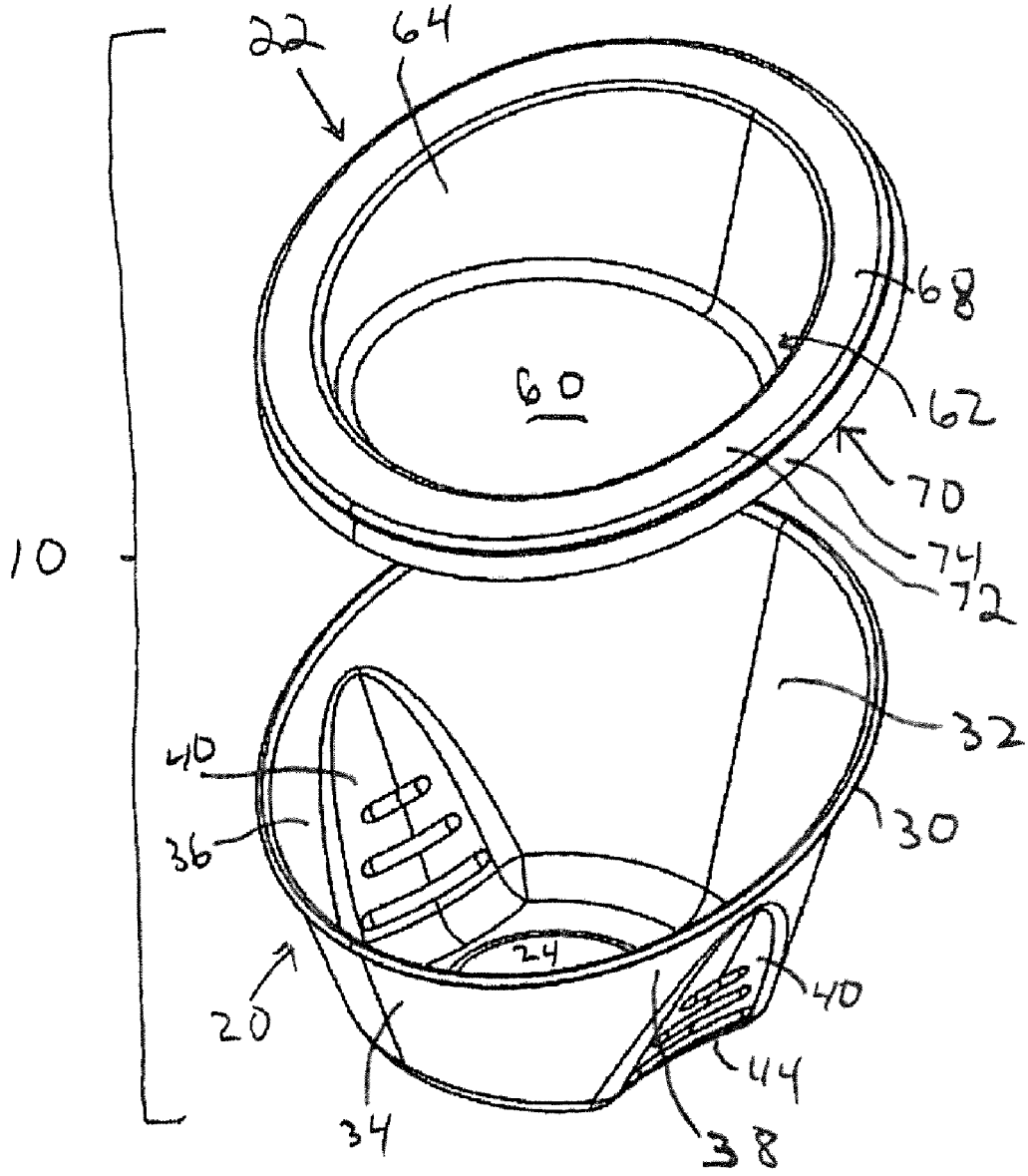
FIG. 6 is a perspective view of the base of FIG. 1 and the lid of FIG. 5 in which the lid is in position over the base.
Figure 7:
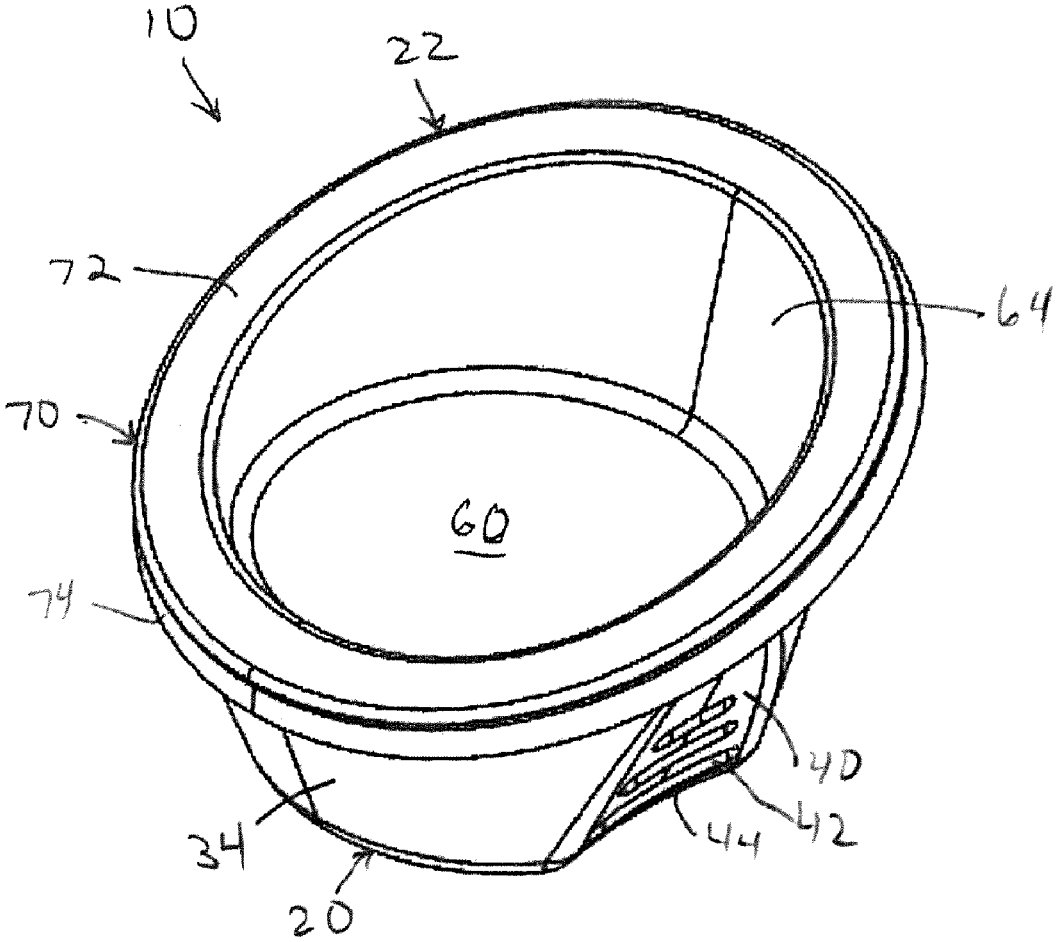
FIG. 7 is a perspective view of the lid attached to the base.

Turning to FIG. 5, the lid 22 includes a bottom 60 and a sidewall 62. The sidewall 62 has a first section 64 that is greater in height than a second section 66. A rim 68 has a seal 70 comprising a first flange 72 and a second flange 74, the seal 70 being adapted to mate over the lip 30 by a friction or snap fit to seal the container base 10, as shown in FIGS. 6-7. The seal 70 can be one which is removable and resealable, or, the seal 70 can be a seal which is formed so that in use, a container 10 filled with condiment has the lid 22 and seal 70 formed to provide a seal which can be unsealed only once (such as a milk jug cap seal). In such an embodiment the seal 70 may have a weakened or frangible area which a user can separate or remove by pulling on a tab 90 (see FIG. 9 and as described hereinbelow).

The container 10 may be made of any suitable material, such as, but not limited to, polymer plastic, stainless steel, aluminum, paper/cellulose, wood, recycled or recyclable material, edible materials, mixtures and combinations of the foregoing or the like and may be formed by any suitable manufacturing process, such as, but not limited to, vacuum forming, blow molding, or the like.

The lid bottom 60 can be marked with a pen, pencil or marker with the contents, or can have a sticker adhered to or a stamp placed on the bottom 60 as advertising.

In one use, a server can place a quantity of liquid, such as a condiment 78 (e.g., ketchup or mustard), sauce (e.g., barbeque) or dressing (e.g., ranch, blue cheese) (the foregoing referred to generically as "condiment(s)", but is intended to include such items as can be contained in the container), in the base 20 and attach the lid 22 to the base 20 to prevent spilling. The container 10 can be served with various food items suitable for dipping, such as, but not limited to, chicken wings, vegetable sticks, fried cheese sticks, spring rolls or the like. The user can then remove the lid 22 and dip the food item into the condiment and wipe the excess condiment on the lip 30, such as proximate the wall first section 32. As the food item is raked across the lip 30 the excess condiment is retained by the lip 30 and flows down the wall 28 and back into the container base 20. The angle and diameter of the wall first section 32 is such that the condiment is retained in the base 20.

A user can pick the base 20 up and hold it between his or her fingers, using the gripping areas 40 to hold the base 20. The gripping surfaces 42 help to maintain the user's grip, particularly when the user's fingers may be slippery, wet or greasy or have excess condiment on them.

Figure 8:
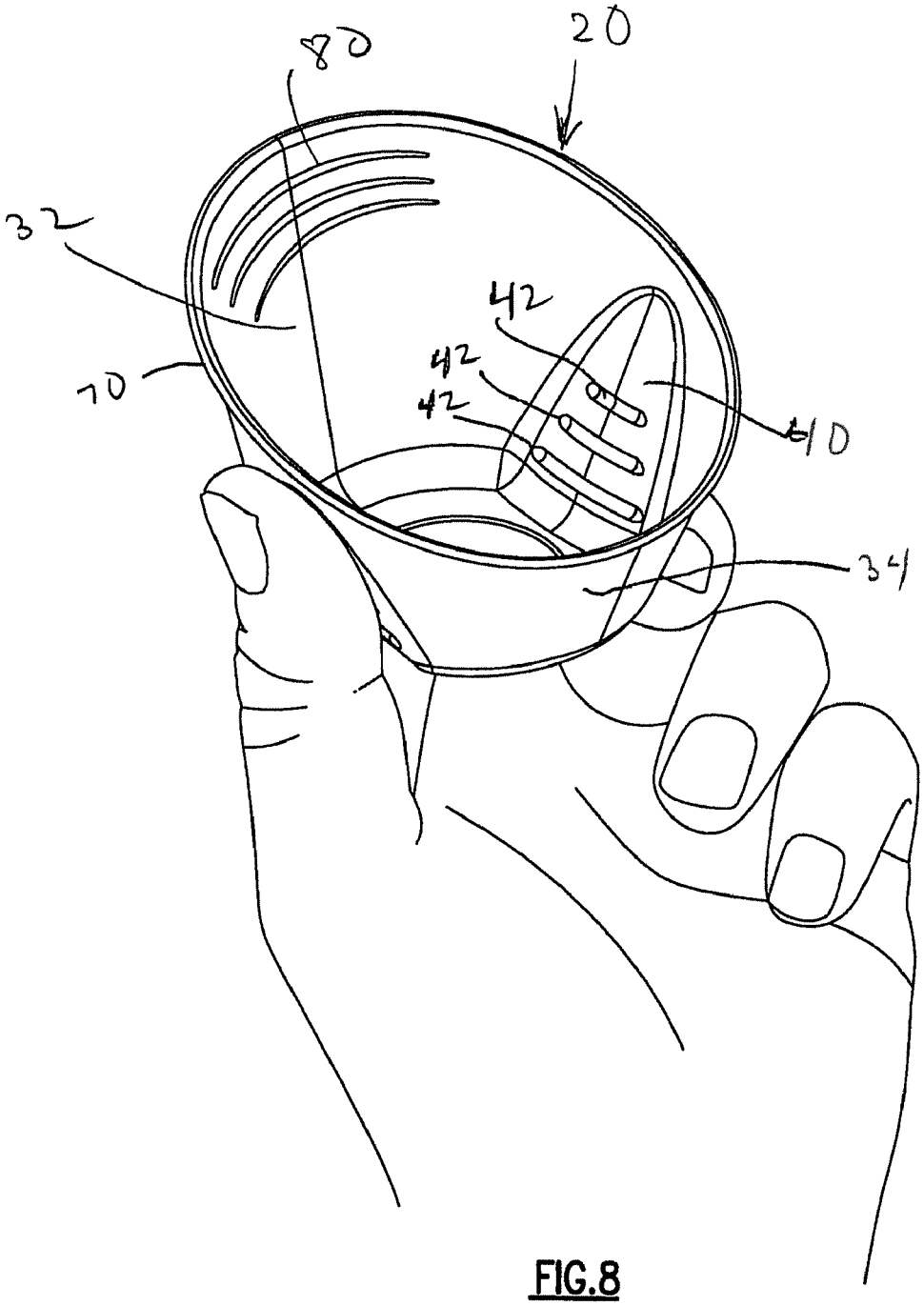
FIG. 8 is a perspective view of a first alternative embodiment of a base, including a plurality of retention devices.
Figure 10:
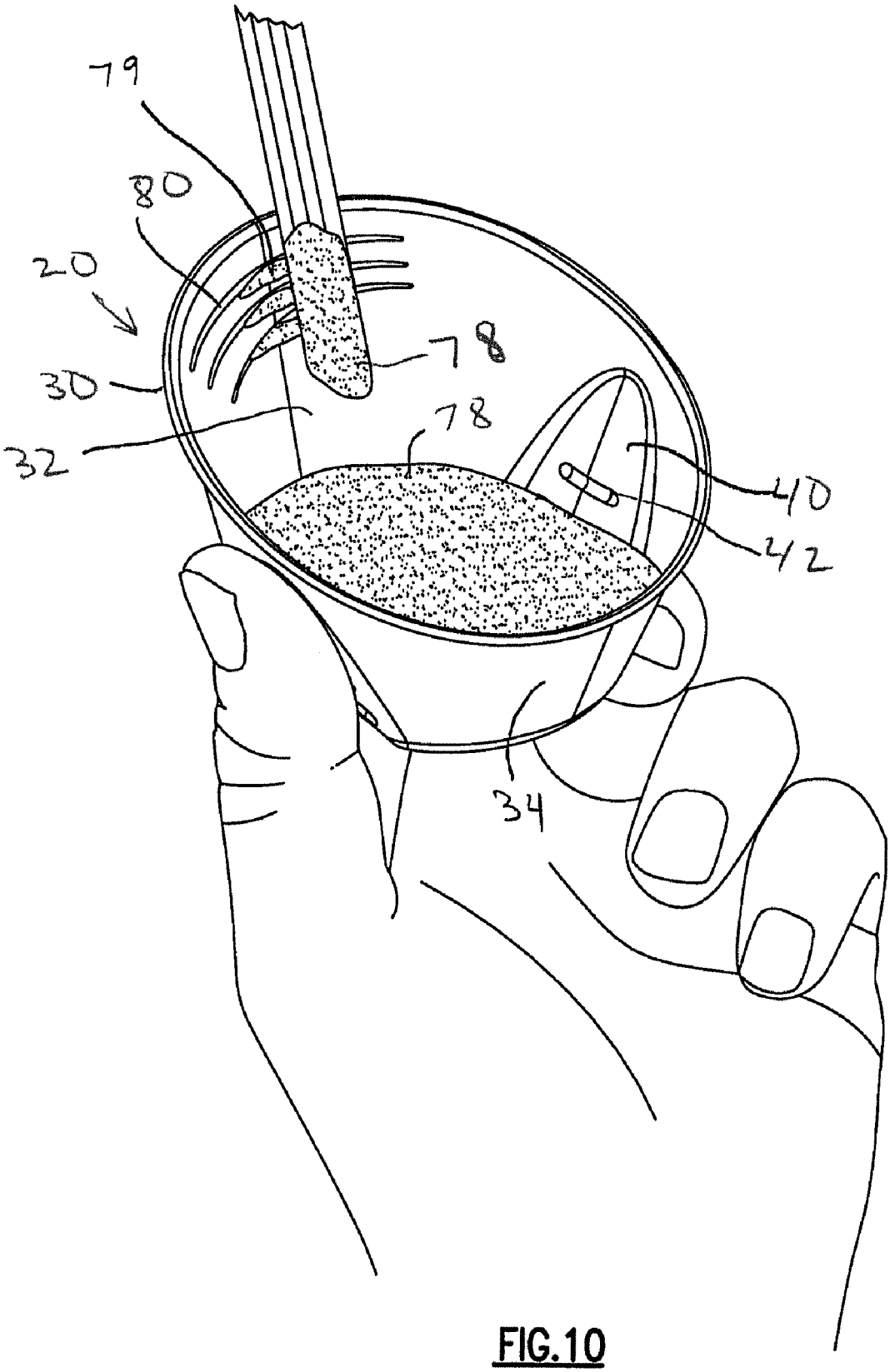
FIG. 10 is a perspective view of a container base with condiment showing a food item being wiped across the lip and retention devices.

In a first alternative embodiment, shown in FIG. 8, the base 20 can have at least one, and preferably a plurality of fluid retention devices 80, such as, but not limited to, protrusions, grooves, recesses, ridges, steps, bumps, spikes, domes, fingers, nibs, combinations and mixtures of the foregoing or the like formed as part of the wall 28, such as part of the first section 34 (it being understood that other portions of the wall can include such retention devices 80). The condiment retention device 80 helps to retain excess 79 condiment 78 (see FIG. 10) when the user wipes the food item across the lip 30 and the wall 32.

The base 20 can be nestably stacked with multiple bases 20 to minimize the area needed for storage. Similarly, the lid 22 can be nestably stacked with a plurality of other lids 22. The base bottom 24 and lid bottom 60 are generally the same diameter so that multiple containers 10 (in which the lid 22 is fitted on the base 20) with or without condiments, can be stacked. In this manner, a set of different condiments can be conveniently carried from kitchen to table by stacking several containers 10 on top of each other without fear of spilling or inadvertently mixing the contents. Containers 10 can be filled with condiments, sealed, and stacked and stored, such as in a refrigerator, until used.

Figure 9:
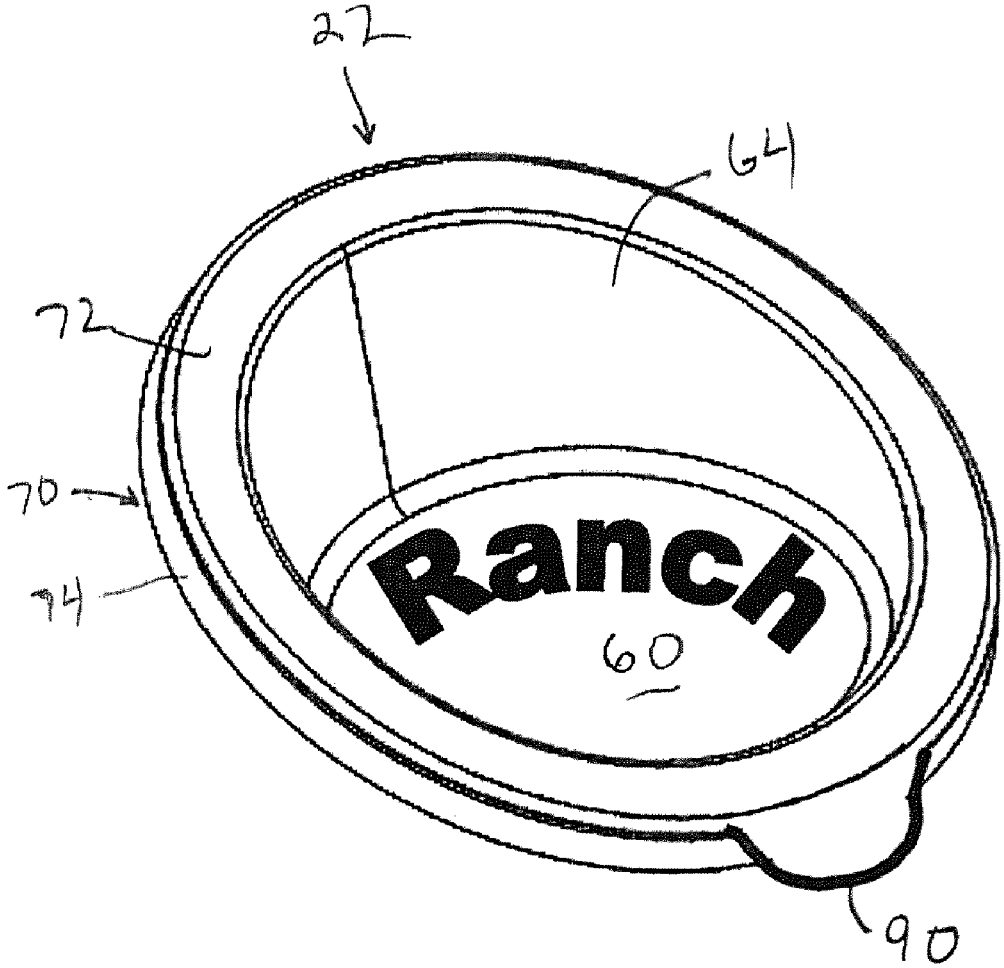
FIG. 9 is a perspective view of a second alternative of a lid including a tab.

The lid 22 can optionally have a tab 90 (as shown in FIG. 9) to aid in removal of the lid 22.

In one exemplary embodiment, the container base 20 can be a 2, 3 or 4 ounce capacity size. It is to be understood that the size and proportions can be adapted for different uses. Similarly, the angle of the wall 28 can be modified as the use requires. For example, the container 10 can be adapted for use as a paint container such that a user can hold the container in one hand and dip a small brush in to reservoir of paint, wiping the excess paint off using the lip 30 or the retention devices 80 (see FIG. 8).

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

It should further be noted that any patents, applications and publications referred to herein are incorporated by reference in their entirety.

What is claimed is:

1. A container for holding and storing sauces and other liquids, comprising:

a) a base having
  i) a generally flat base bottom,
  ii) a generally frusto-conical wall extending upward from the bottom and having a rim, the wall having
    a) a first section,
    b) a second section opposing the first section, the first section having a height greater than the second section,
    c) a third section, and
    d) a fourth section opposing the third section, the third and fourth sections each having an inwardly curved gripping section, the gripping section having at least one gripping surface iii) a lip extending substantially around the rim of the wall; and, b) a lid adapted to snap fit over the lip, the lid having i) a generally flat lid bottom, ii) a lid wall extending upward from the lid bottom, the lid wall having a first section and a second section, the first section having a height greater than the second section, iii) a seal portion comprising a first flange extending generally outward and generally perpendicular to the lid wall and a second flange extending generally downward from the first flange, the seal portion being adapted to mate with the lid and form a seal therewith, whereby the lid wall first section is generally aligned with the base wall first section.

2. The container of claim 1, wherein the gripping section includes a plurality of retention devices selected from the group consisting of protrusions, grooves, recesses, ribs, ridges, steps, bumps, spikes, domes, fingers, nibs, and combinations of the foregoing.

3. The container of claim 1, wherein the base wall tapers outward from the bottom toward the lip.

4. The container of claim 1, wherein the lid bottom is adapted to receive printed indicia thereon.

5. The container of claim 1, wherein the base wall further includes at least one condiment retention device selected from the group consisting of protrusions, grooves, recesses, ribs, ridges, steps, bumps, spikes, domes, fingers, nibs, and combinations of the foregoing.

6. A container for holding and storing sauces and other liquids, comprising:

a) a base having i) a generally flat base bottom, ii) a generally frusto-conical or cylindrical wall extending upward from the bottom and having a rim, the wall having a) a first section, b) a second section opposing the first section, the first section having a height greater than the second section, c) a third section, d) a fourth section opposing the third section, the third and fourth sections each having an inwardly curved gripping portion, the gripping portion having at least one gripping surface, and e) at least one condiment retention device selected from the group consisting of protrusions, grooves, recesses, ribs, ridges, steps, bumps, spikes, domes, fingers, nibs, and combinations of the foregoing, iii) a lip extending substantially around the rim of the wall; and, b) a lid adapted to snap fit over the lip, the lid having i) a generally flat lid bottom, ii) a lid wall extending upward from the lid bottom, the lid wall having a first section and a second section, the first section having a height greater than the second section, iii) a seal portion comprising a first flange extending generally outward and generally perpendicular to the lid wall and a second flange extending generally downward from the first flange, the seal portion being adapted to mate with the lid and form a seal therewith, whereby the lid wall first section is generally aligned with the base wall first section.

7. A container for holding and storing sauces and other liquids, comprising:

a) a base having i) a generally flat base bottom, ii) a wall extending upward from the bottom and having a rim, the wall having a) a first section and a second section, the first section opposing the second section and having a height greater than the second section for facilitating wiping a food item along the first section to remove excess condiment, b) means for gripping the wall by a user's fingers, and c) at least one retention means for retaining excess condiment from a food item, iii) a lip extending substantially around the rim of the wall; and, b) a lid adapted to snap fit over the lip, the lid having i) a generally flat lid bottom, ii) a lid wall extending upward from the lid bottom, the lid wall having a first section and a second section, the first section having a height greater than the second section, iii) means for sealing the lid to the base lip.

* * * * *